US007114449B2

(12) United States Patent
Altenau

(10) Patent No.: US 7,114,449 B2
(45) Date of Patent: Oct. 3, 2006

(54) METHOD FOR PRODUCING A LARGE-CALIBER, HIGH-EXPLOSIVE PROJECTILE, AND HIGH-EXPLOSIVE PROJECTILE PRODUCED IN ACCORDANCE WITH THE METHOD

(75) Inventor: Ernst-Wilhelm Altenau, Duisburg (DE)

(73) Assignee: Rheinmetall W & M GmbH, Unterluss (DE)

( * ) Notice: Subject to any disclaimer, the term of this patent is extended or adjusted under 35 U.S.C. 154(b) by 0 days.

(21) Appl. No.: 10/953,190

(22) Filed: Sep. 30, 2004

(65) Prior Publication Data

US 2006/0011053 A1 Jan. 19, 2006

Related U.S. Application Data

(62) Division of application No. 10/369,774, filed on Feb. 21, 2003, now Pat. No. 6,860,185.

(30) Foreign Application Priority Data

Feb. 21, 2002 (DE) ..... 102 07 209

(51) Int. Cl.
*F42B 12/20* (2006.01)

(52) U.S. Cl. ..... 102/473; 102/479; 102/499; 86/51

(58) Field of Classification Search ..... 102/473–500
See application file for complete search history.

(56) References Cited

U.S. PATENT DOCUMENTS

| | | | | |
|---|---|---|---|---|
| 2,276,110 A | * | 3/1942 | Snelling | 102/499 |
| 2,279,416 A | * | 4/1942 | Snelling | 102/499 |
| 2,373,883 A | | 4/1945 | Ferrel | |
| 3,000,309 A | * | 9/1961 | Zapf | 102/493 |
| 3,218,975 A | * | 11/1965 | Massey | 102/476 |
| 3,491,694 A | * | 1/1970 | Fountain | 102/493 |
| 3,599,570 A | * | 8/1971 | Ingersoll et al. | 102/499 |
| 3,967,527 A | | 7/1976 | Dunn et al. | |
| 3,983,820 A | | 10/1976 | Crepin | |
| 4,112,849 A | | 9/1978 | Jones | |
| 4,152,987 A | | 5/1979 | Lundstrom et al. | |
| 4,167,140 A | | 9/1979 | Biserod | |
| 4,365,556 A | | 12/1982 | Reibel | |
| 4,369,711 A | | 1/1983 | Leader | |
| 4,395,934 A | | 8/1983 | Axelrod et al. | |

(Continued)

FOREIGN PATENT DOCUMENTS

DE 39 29 020 A1 3/1991

(Continued)

*Primary Examiner*—Troy Chambers
(74) *Attorney, Agent, or Firm*—Venable LLC; Stuart I. Smith

(57) ABSTRACT

A method for producing a large-caliber, high-explosive projectile (1, 1'), and a projectile formed according the method, having a projectile casing (2, 2') that surrounds a chamber (6, 6') filled with an explosive charge (9, 9'), and that has a mouth (5, 5') at its tip that can be sealed, and through which the explosive charge (9, 9') is inserted into the chamber (6, 6') of the high-explosive projectile (1, 1'). The explosive charge (9, 9') is disposed in a plastic casing (8), comprised of an elastic material, inside the chamber of the high-explosive projectile (1, 1'). Additional tensioning means (11, 11', 17, 17') are provided to compensate for the varying volume of the explosive charge (9, 9') relative to the projectile casing (2, 2') if the temperature fluctuates dramatically and maintain the explosive charge (9, 9') under a pre-stress, particularly when using a plastic bound explosive charge (9, 9').

13 Claims, 2 Drawing Sheets

U.S. PATENT DOCUMENTS

| | | | | |
|---|---|---|---|---|
| 4,438,700 | A | | 3/1984 | Knapp |
| 4,461,214 | A | | 7/1984 | Black |
| 4,574,702 | A | * | 3/1986 | Brandt ..... 102/476 |
| 4,760,795 | A | | 8/1988 | Young |
| 4,833,994 | A | * | 5/1989 | Strobush ..... 102/476 |
| 4,860,659 | A | | 8/1989 | Andreetta |
| 4,876,964 | A | | 10/1989 | Strandli et al. |
| 4,945,834 | A | | 8/1990 | Young |
| 5,054,399 | A | | 10/1991 | Bilek et al. |
| 5,133,259 | A | | 7/1992 | Schluckebier |
| 5,210,372 | A | | 5/1993 | Tripptrap et al. |
| 5,313,890 | A | | 5/1994 | Cuadros |
| 5,317,975 | A | | 6/1994 | Sauvestre et al. |
| 5,419,024 | A | | 5/1995 | Koontz et al. |
| 5,939,662 | A | | 8/1999 | Bootes et al. |
| 6,283,037 | B1 | | 9/2001 | Sclafani |
| 6,655,294 | B1 | | 12/2003 | Kerr |

FOREIGN PATENT DOCUMENTS

| | | |
|---|---|---|
| DE | 196 48 355 A1 | 7/1999 |
| GB | 1 212 116 | 11/1970 |
| GB | 1 439 450 | 6/1976 |

* cited by examiner

METHOD FOR PRODUCING A LARGE-CALIBER, HIGH-EXPLOSIVE PROJECTILE, AND HIGH-EXPLOSIVE PROJECTILE PRODUCED IN ACCORDANCE WITH THE METHOD

CROSS REFERENCE TO RELATED APPLICATIONS

This application is a divisional application of application Ser. No. 10/369,774 filed Feb. 21, 2003 now U.S. Pat. No. 6,860,185, which claims priority of the German Patent Application No. DE 102 07 209.4 filed Feb. 21, 2002.

BACKGROUND OF THE INVENTION

The invention relates to a method for producing a large-caliber, high-explosive projectile having a projectile casing, which surrounds a chamber filled with an explosive charge and having at its tip a mouth, which can be sealed and through which the explosive charge is inserted into the chamber of the high-explosive projectile. The invention further relates to a high-explosive projectile that is produced in accordance with the method.

In many cases, insensitive explosive charges must be processed in military technology. The explosive charges are typically plastic-bound and, despite being highly effective, are relatively insensitive. A drawback of plastic-bound explosive charges, however, is that they have a relatively large thermal-expansion coefficient, which may be eight to twelve times larger than that of a steel projectile casing of a corresponding high-explosive projectile. In this type of explosive-filled projectile, tensions occur at positive temperatures, so the explosive body is held in the projectile casing, whereas the explosive body compresses at lower temperatures and rests loosely in the projectile casing.

SUMMARY OF THE INVENTION

It is the object of the invention to provide a method for producing a large-caliber, high-explosive projectile in which the explosive body is always held with a prestress in the projectile casing, even when the temperature fluctuates dramatically, in the use of plastic-bound explosive charges.

In accordance with the invention, this object is accomplished, with respect to the method, by a method for producing a large-caliber, high-explosive projectile having a projectile casing, which surrounds a chamber filled with an explosive charge, and has, at its tip, a mouth that can be sealed, and through which the explosive charge is inserted into the chamber of the projectile, with the method generally comprising the following steps:

first, a folded or compressed, sack-like plastic casing formed of an elastic material is inserted into the chamber of the high-explosive projectile through the mouth, with the dimensions of the unfolded plastic casing essentially corresponding to the dimensions of the chamber of the high-explosive projectile;

the plastic casing is then unfolded inside the chamber of the high-explosive projectile so that it rests in a form-fit against the inside walls of the chamber of the high-explosive projectile;

the explosive charge is then inserted into the plastic casing through the mouth, for example, by pouring in of the explosive powder; and the mouth is then sealed.

The above object generally is achieved according to the invention with respect to the projectile by a large-caliber, high-explosive projectile having a projectile casing that a chamber filled with an explosive charge and that has, at its tip, a mouth that can be sealed with a nose fuse, and wherein:

a sack-shaped plastic casing, in which the explosive charge is located, is disposed at the inside walls of the chamber of the high-explosive projectile casing; and, the explosive charge is sealed at the front by an elastic spacer disk and an adapter member on which the nose fuse is mounted and that exerts a predetermined pressure on the side of the disk facing away from the explosive charge to pre-stress the explosive charge.

Further, especially advantageous, embodiments of the invention are disclosed.

The invention is essentially based on the concept of disposing the explosive charge in a plastic casing, comprising an elastic material, inside the high-explosive projectile, so when the temperature fluctuates, the elastic plastic casing contains the varying volume of the explosive charge. Because the explosive charge used in large-caliber, spin-stabilized artillery projectiles usually can only be filled via a small mouth in the casing (nose fuse opening), it is impossible to insert explosive charges that are pre-packaged in a plastic film into the chamber of such a high-explosive projectile. The invention therefore proposes placing only one folded or compressed, sack-like plastic casing into the chamber of the high-explosive projectile, with the dimensions of the unfolded casing essentially corresponding to those of the projectile casing chamber of the high-explosive projectile. The plastic casing is then unfolded, for example, through inflation or due to its elastic restoring forces, so that it rests in a form-fit against the chamber wall of the high-explosive projectile. The pourable, plastic-bound explosive charge is then likewise inserted into the plastic casing through the mouth. After the plastic-bound explosive has polymerized, the mouth is sealed, for example, through the screwing in of a nose fuse.

To ensure that the explosive body can be held under a prestress in the projectile casing, even with dramatic temperature fluctuations, it has proven useful to provide additional tensing means that compensate the varying volume of the explosive charge relative to the projectile casing.

It has also proven advantageous to mount an elastic spacer disk on the explosive charge prior to sealing the mouth. When the head fuse or an adapter member connected to the head fuse subsequently is screwed in, the disk is compressed slightly by these parts, so the explosive charge is constantly under a prestress.

In spin-stabilized, high-explosive projectiles, to assure a good spin transfer between the projectile casing and the explosive charge, the plastic casing can be glued to the inside wall of the projectile chamber, at least in small regions. Furthermore, the spin transfer from the projectile casing to the explosive can be promoted by a polygonal embodiment of the inner chamber walls, at least in a region of the floor.

Tests performed by the Applicant have revealed that, when the high-explosive projectile of the invention is fired without any special measures, a good spin transfer nevertheless occurs between the projectile casing and a plastic-bound explosive charge, because the explosive mass is deformed during firing due to the plastic component, and "solidifies" with the plastic casing in the projectile casing.

The plastic casing may be a smooth film or a roofed film, with which pre-formed fragments can be produced after the explosive charge is detonated. To this end, annular segments are provided with roof-like protuberances that extend in the longitudinal direction of the high-explosive projectile. The roof-like protuberances of adjacent annular segments are offset from one another by one-half of a roof.

To assure a fast, reliable and thorough ignition of the explosive charge, it has proven advantageous for a supplemental charge to be disposed downstream of the fuse. On its side facing the explosive charge, this supplemental charge has an inset with the contour of a shaped-charge. It is further advantageous for the spacer disk to have an axially extending, central recess, so the shaped-charge force created after the supplemental charge has been ignited reaches the explosive charge unimpeded. The contour of the shaped-charge inset may be a flat or pointed cone.

For additionally accelerating the ignition process, a further embodiment of the invention provides that an ignition tube extends axially into the explosive charge at the central recess of the spacer disk, with an igniter charge being disposed at the end of the tube that faces away from the spacer disk.

Further details about and advantages of the invention ensue from the following description of embodiments illustrated in the figures.

DESCRIPTION OF THE PREFERRED EMBODIMENTS

Figure 1:
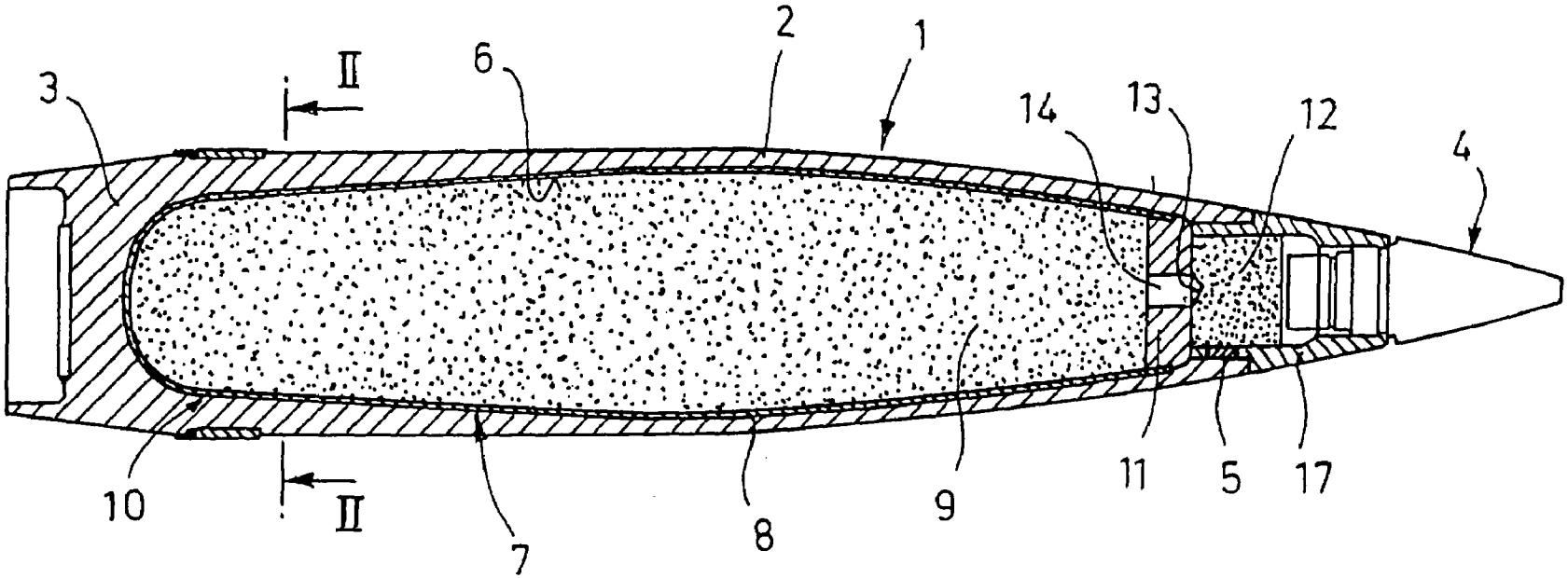
FIG. 1 is a longitudinal section through a first exemplary embodiment of a high-explosive projectile according to the invention.

Referring now to FIG. 1, there is shown a large-caliber, spin-stabilized, high-explosive projectile 1 such as may be fired from an armored howitzer. The high-explosive projectile 1 includes a projectile casing 2 having a floor portion 3 and a forward nose fuse 4. The nose fuse 4 is screwed into an adapter member 17, which is in turn screwed into a mouth 5 of the projectile casing 2.

The projectile casing 2 surrounds and defines a chamber 6, having inside walls 7 engaged by a sack-like, elastic (rubbery) plastic casing 8 that houses a plastic-bound explosive charge 9. Preferably the casing 8 is glued to the walls 7 with an adhesive. The plastic casing 8 preferably has a smooth surface as shown. The wall thickness of the plastic casing 8 is advantageously between 0.3 and 0.6 mm. It has also proven advantageous for the material of the plastic casing 8 to comprise a plastic having a rubber component of about 30%.

Figure 2:
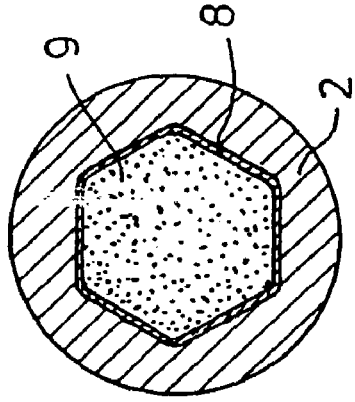
FIG. 2 is a cross-section through the high-explosive projective shown in FIG. 1, along the line II—II.

In the floor region 10 of the high-explosive projectile 1, the projectile casing 2 and the plastic casing 8 preferably have a polygonal form or shape, as shown in FIG. 2, for assuring a good spin transfer from the projectile casing 2 to the explosive charge 9.

At the front, i.e., the end facing the projectile tip or nose, the explosive charge 9 is closed off or covered by an elastic spacer disk 11. On the side of the disk 11 facing away from the explosive charge 9, the adapter member 17 extends into the mouth 5 of the projectile casing 2 and is secured there, e.g., via a screw connection. The adaptor member 17 is secured to exert a predeterminable pressure on the disc 11, so that the explosive charge 9 is under a prestress.

At its rear, the nose fuse 4 projects into the adapter member 17, which contains a supplemental charge 12 that has the contour of a shaped-charge axial inset 13 on its side facing the explosive charge 9. The spacer disk 11 further has an axially extending recess or bore 14, so that, after the supplemental charge 12 has been ignited, the resulting shaped-charge force reaches the explosive charge 9 through this recess 14, and ignites the charge 9.

To insert the explosive charge 9 into the high-explosive projectile 1, it may be necessary to apply an adhesive to the inside walls 7 of the projectile casing 2. The plastic casing 8 is then compressed or folded to allow it to be pushed through the mouth 5 into the chamber 6 of the casing 2. In the chamber 6, the plastic casing 8 expands again due to internal tension as a result of its shape and material or is expanded by the introduction of air or another gas, and rests against the inside walls 7 of the projectile casing 2. The explosive charge 9 can subsequently be inserted into the plastic casing 8, and the elastic spacer disk 11 can be mounted on the explosive charge 9. Finally, the adapter member 17 is screwed into the mouth 5, and the head fuse 4 is connected to the adapter member 17 in a known manner.

Figure 3:
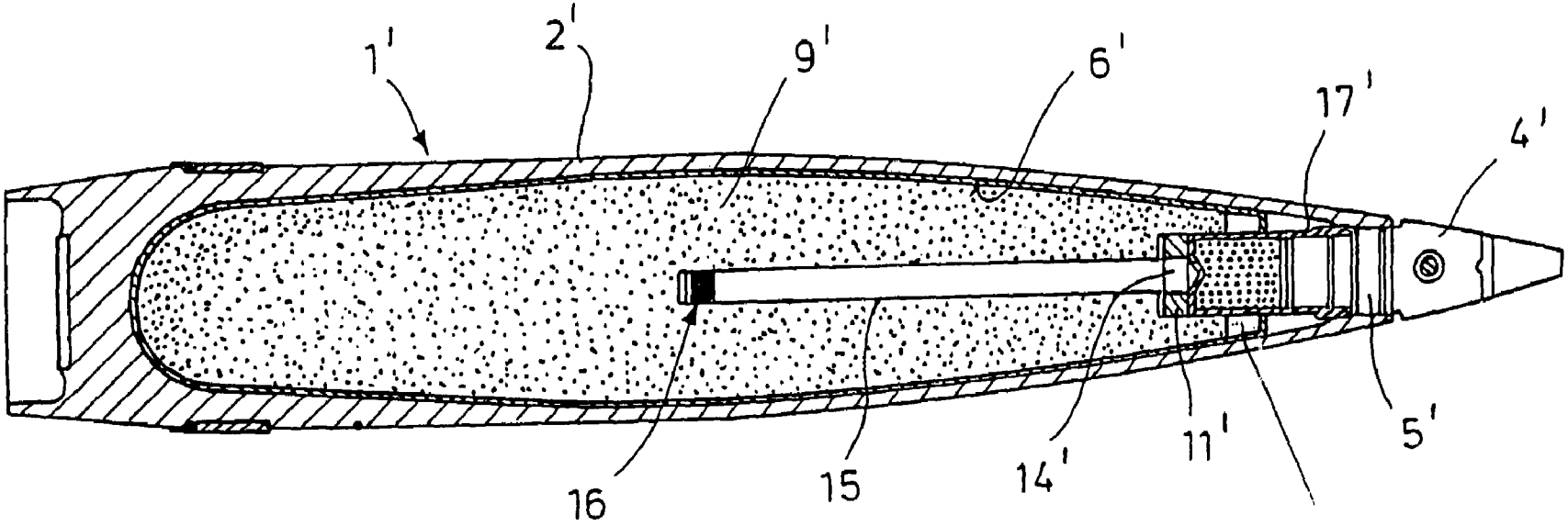
FIG. 3 is a longitudinal section through a second exemplary embodiment of a high-explosive projectile according to the invention.

Of course, the invention is not limited to the above-described embodiment. As can be seen from the high-explosive projectile 1' illustrated in FIG. 3, the elastic spacer disk represented by 11' need not extend over the entire cross-section of the chamber 6' of the projectile casing 2'. In this case, the adapter member 17' is located completely inside the projectile casing 2', and the nose fuse 4' is screwed directly into the mouth 5'.

For assuring a fast, uniform ignition of the explosive charge 9', it is also possible to provide an ignition tube 15, which adjoins the recess 14' of the spacer disk 11' and extends axially into the explosive charge 9'. At the end facing away from the spacer disk 11', the ignition tube 15 has an igniter charge 16. It is to be understood that the tube 15 with charge 16 can likewise be used in the projectile of FIG. 1.

If pre-formed fragments are supposed to be created in a simple manner in the detonation of the high-explosive projectile, the plastic casing can be a roofed film instead of a smooth film. Roofed films have annular, axially adjacent segments that are provided with roof-like protuberances, which extend in the longitudinal direction of the high-explosive projectile. The roof-shaped protuberances of adjacent, annular segments are offset from one another by one-half of a roof.

The invention now being fully described, it will be apparent to one of ordinary skill in the art that many changes and modifications can be made thereto without departing from the spirit or scope of the invention as set forth herein.

The invention claimed is:

1. A large-caliber, high-explosive projectile comprising:

a projectile casing, that surrounds a chamber, and that has a mouth that can be sealed at its tip;

an explosive charge filling the chamber;

a sack-shaped plastic casing, in which the explosive charge is located, disposed adjacent inside walls of the high explosive projectile casing defining the chamber;

an elastic spacer disk disposed on the explosive charge adjacent the mouth of the projectile casing and covering the explosive charge; and an adapter member having a nose fuse for the projectile mounted thereon disposed in and extending into the mouth of the projectile casing, and being secured to the projectile casing to exert a predeterminable pressure on a side of the disk facing away from the explosive charge.

2. The large-caliber, high-explosive projectile according to claim 1, wherein the explosive charge is a plastic-bound explosive charge.

3. The large-caliber, high-explosive projectile according to claim 2, wherein the plastic casing is a smooth film.

4. The large-caliber, high-explosive projectile according to claim 2, further comprising:

a supplemental charge disposed downstream of the nose fuse within the adapting member and having an axially disposed recess on a side facing the spacer disk and the explosive charge; and an axially extending, central passage in the spacer disk so that a shaped-charge force created after the supplemental charge has been ignited enters the explosive charge unimpeded.

5. The large-caliber, high-explosive projectile according to claim 4, further comprising:

an ignition tube extending axially into the explosive charge from the central passage of the spacer disk; and an igniter charge disposed at an end of the tube facing away from the spacer disk.

6. The large-caliber, high-explosive projectile according to claim 2, wherein the inside walls of the projectile casing defining the chamber have a polygonal shape in at least a floor region of the projectile casing.

7. The large-caliber, high explosive projectile according to claim 2, further comprising an adhesive layer between the inside walls and the plastic casing, whereby the plastic casing is attached to the inside walls in a frictional lockup.

8. The large-caliber, high-explosive projectile according to claim 1 wherein the disk completely covers the explosive charge.

9. The large-caliber, high-explosive projectile according to claim 1, wherein the plastic casing is a smooth film.

10. The large-caliber, high-explosive projectile according to claim 1, further comprising:

a supplemental charge disposed downstream of the nose fuse within the adapting member and having an axially disposed recess on a side facing the spacer disk and the explosive charge; and an axially extending, central passage in the spacer disk so that a shaped-charge force created after the supplemental charge has been ignited enters the explosive charge unimpeded.

11. The large-caliber, high-explosive projectile according to claim 10, further comprising:

an ignition tube extending axially into the explosive charge from the central passage of the spacer disk; and an igniter charge disposed at an end of the tube facing away from the spacer disk.

12. The large-caliber, high-explosive projectile according to claim 1, wherein the inside walls of the projectile casing defining the chamber have a polygonal shape in at least a floor region of the projectile casing.

13. The large-caliber, high explosive projectile according to claim 1, further comprising an adhesive layer between the inside walls and the plastic casing, whereby the plastic casing is attached to the inside walls in a frictional lockup.

* * * * *